US008403521B2

(12) United States Patent
Wang

(10) Patent No.: US 8,403,521 B2
(45) Date of Patent: Mar. 26, 2013

(54) STRUCTURALLY IMPROVED FLASHLIGHT

(75) Inventor: Ching-Hsiang Wang, Tainan (TW)

(73) Assignee: Shih-Hao Wang, Tainan (TW)

( * ) Notice: Subject to any disclaimer, the term of this patent is extended or adjusted under 35 U.S.C. 154(b) by 208 days.

(21) Appl. No.: 13/038,433

(22) Filed: Mar. 2, 2011

(65) Prior Publication Data

US 2012/0224361 A1 Sep. 6, 2012

(51) Int. Cl.
*F21L 4/04* (2006.01)

(52) U.S. Cl. ..... 362/205; 362/109

(58) Field of Classification Search ..... 362/109–120, 362/183–208

See application file for complete search history.

(56) References Cited

U.S. PATENT DOCUMENTS 5,911,497 A * 6/1999 Mele ..... 362/202

* cited by examiner

*Primary Examiner* — Jason Moon Han

(74) *Attorney, Agent, or Firm* — Alan Kamrath; Kamrath IP Lawfirm, P.A.

(57) ABSTRACT

A structurally improved flashlight includes a handle coupled to a main body at a bottom of the main body. The handle has a trigger assembled between a pair of housing parts. The trigger is formed with a zigzag room that is communicated with openings formed at two laterals of the trigger for accommodating a safety mechanism. A magnet provided at an upper surface of the trigger is to removably engage a reed switch installed on the flashlight main body. A spring is deposited between the trigger and the two housing parts, so as to enable the trigger to resiliently move to and fro. The trigger is for conveniently switching the flashlight among different illumination phases, such as light intensity, blinking and on/off status. The structurally improved flashlight is also designed to be held in a certain illumination phase temporarily, so as to prevent unintentional change of the set illumination phase.

2 Claims, 8 Drawing Sheets

STRUCTURALLY IMPROVED FLASHLIGHT

BACKGROUND OF THE INVENTION

1. Technical Field

The present invention relates to flashlights, and more particularly, to a structurally improved flashlight, which has a trigger assembled to a handle thereof for conveniently switching the flashlight among different illumination phases, such as light intensity, blinking and on/off status. The structurally improved flashlight is designed to be held in a certain illumination phase temporarily, so as to prevent unintentional change of the set illumination phase.

2. Description of Related Art

A conventional flashlight typically has a switch installed on its main body for turning on or off its illumination. However, the switch such positioned is likely to cause the flashlight less waterproof because it breaks the structural integrity of the main body to some extent. Thus, the relevant manufacturers have been trying hard to improve the optional manageability without compromising desired waterproofing, and to further provide flashlights with variable light intensity.

Furthermore, there are flashlights featuring focal variability and/or water-sealing capability. These flashlights are usually designed to be operated by a manual rotatory motion, and can not be held at a certain illumination phase in use. As a result, such a flashlight may have its illumination phase unintentionally changed, causing its use inconvenient.

SUMMARY OF THE INVENTION

In view of the inconvenience of the prior-art device in controlling illumination phases, the present invention herein proposes a structurally improved flashlight that has a trigger assembled to a handle thereof for conveniently switching the flashlight among different illumination phases, such as light intensity, blinking and on/off status. The structurally improved flashlight is designed to be held in a certain illumination phase temporarily, so as to prevent unintentional change of the set illumination phase.

One objective of the present invention is to provide a structurally improved flashlight that has a main body and a handle coupled to the main body at a guiding groove depressed from a bottom of the main body, wherein the handle is composed of a pair of matching housing parts, a trigger, a safety mechanism and a spring; each of the two housing parts having a notch for accommodating the trigger; a zigzag room being formed at a lower part of the trigger and communicated with openings formed at two laterals of the trigger, so that the safety mechanism having a downward extending retaining portion is allowed to be set in the zigzag room with two ends of the safety mechanism jutting out of two aligned holes formed on the two housing parts; a magnet being provided at an upper surface of the trigger for removably engaging a reed switch installed on the main body; a hole being formed at a rear surface of the trigger for receiving one end of the spring, such that an opposite end of the spring is received in recesses formed in the two housing parts to press against the housing parts, thereby enabling the trigger to resiliently move to and fro. The handle such assembled serves to control illumination phases of the flashlight. When pulled backward, the trigger makes the magnet depart from the reed switch on the main body, and when released, the trigger returns to its normal position to make the magnet approach and correspond to the reed switch again, thereby switching a light source in the main body in terms of light intensity, blinking, and on/off status according to preset programs.

Another objective of the present invention is to provide a structurally improved flashlight that has a main body and a handle coupled to the main body at a guiding groove depressed from a bottom of the main body, wherein the handle is composed of a pair of matching housing parts, a trigger, a safety mechanism and a spring, a trigger being placed in a room formed in the two housing parts, openings being formed on laterals of the trigger for receiving the safety mechanism therebetween, a zigzag room being formed at a lower part of the trigger between the openings for receiving a retaining portion provided at a bottom of the safety mechanism such that the safety mechanism has two ends thereof jutting out of passages provided on the two housing parts, a magnet being deposited on an upper surface of the trigger for removably engaging a reed switch installed on the main body, and a spring being arranged between a hole formed at a rear surface of the trigger and recesses formed on the two housing parts, so as to enable the trigger to resiliently move to and from; and When manually pushed through one of the openings formed at the lateral of the trigger, the safety mechanism moving in a predetermined direction so that the retaining portion corresponding to a front end of the zigzag room is allowed to be placed into a limiting site formed at a side of the zigzag room, which limiting site retains the safety mechanism and disallows the trigger to be pushed frontward by the spring, thereby holding the flashlight in a certain illumination phase temporarily, and, for releasing the flashlight from the illumination phase, when the safety mechanism is manually pushed through the other opening, the retaining portion leaving the limiting site of the zigzag room, so as to allow the trigger to be pushed frontward by the spring again.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE INVENTION

Figure 2:
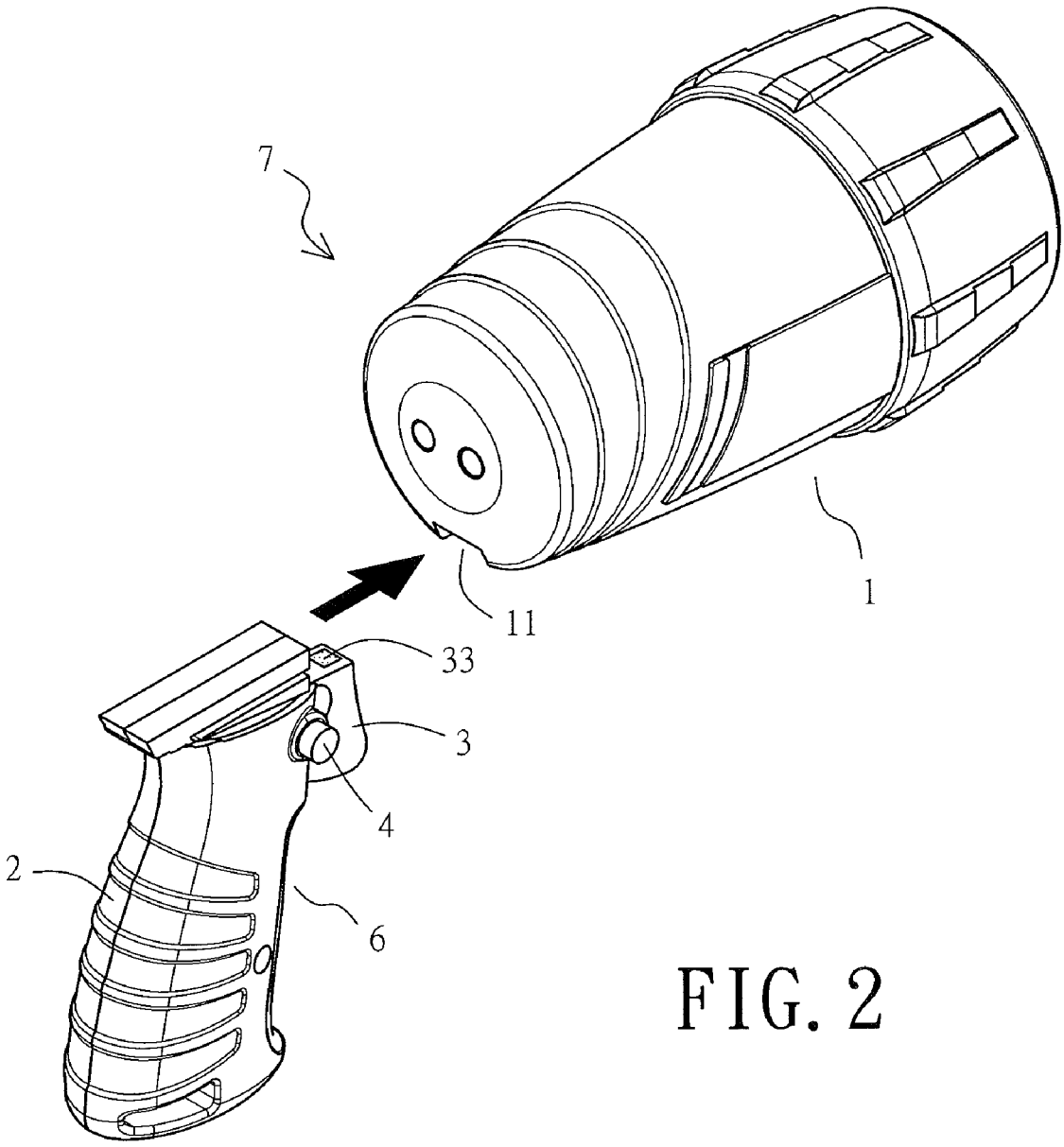
FIG. 2 is a schematic drawing of the present invention showing the main body and the handle are to be assembled.
Figure 3:
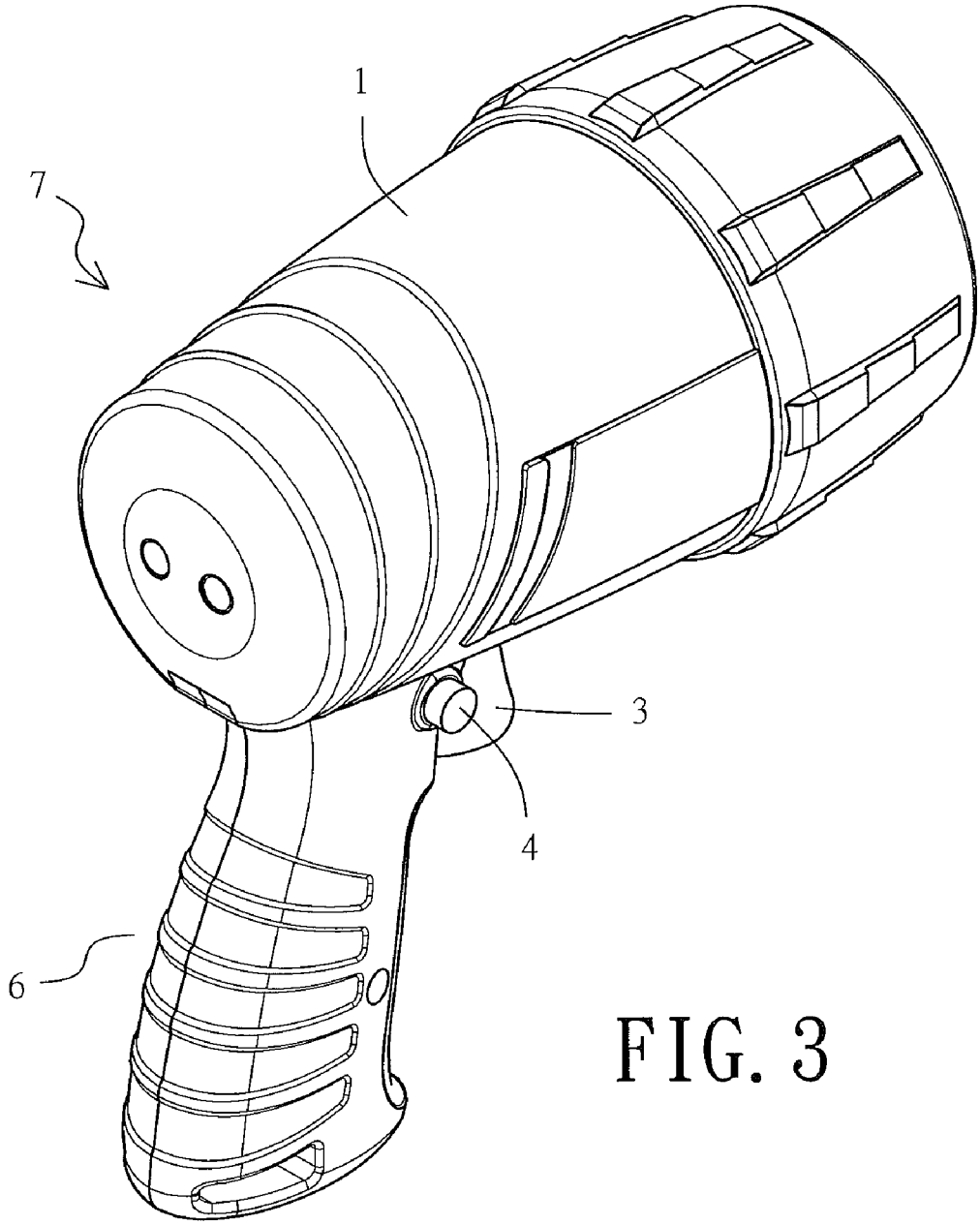
FIG. 3 is a schematic drawing of the present invention showing the main body and the handle have been assembled.

According to the present invention, a structurally improved flashlight, as shown in FIG. 2 and FIG. 3, is a flashlight (7)

comprising a main body (1) and a handle (6) coupled to the main body (1) at a guiding groove (11) depressed from a bottom of the main body (1).

Figure 1:
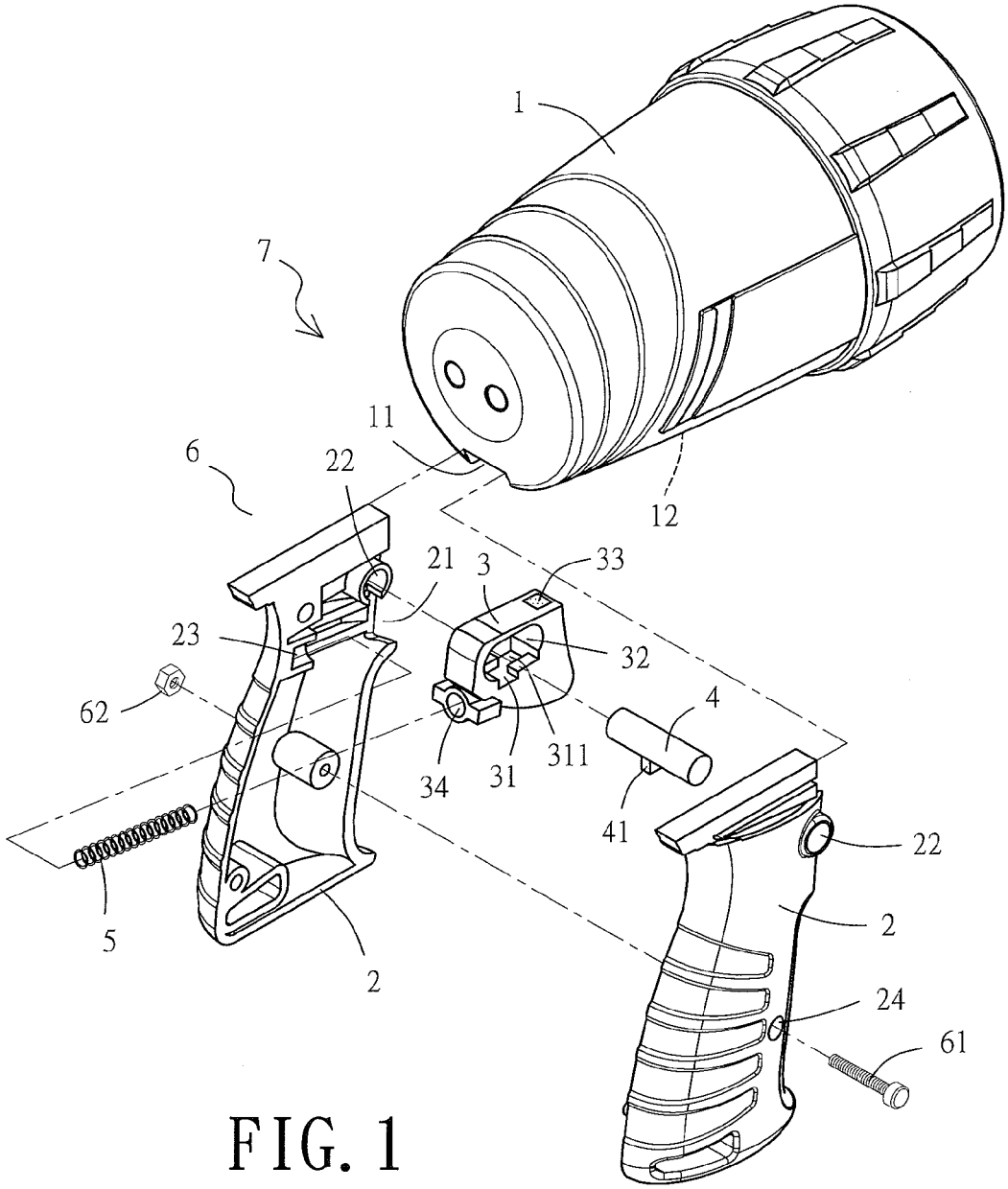
FIG. 1 is a schematic drawing of the present invention wherein a handle to be combined with a main body is exploded.

The handle (6), as shown in FIG. 1, is composed of a pair of matching housing parts (2), a trigger (3), a safety mechanism (4) and a spring (5).

Figure 4:
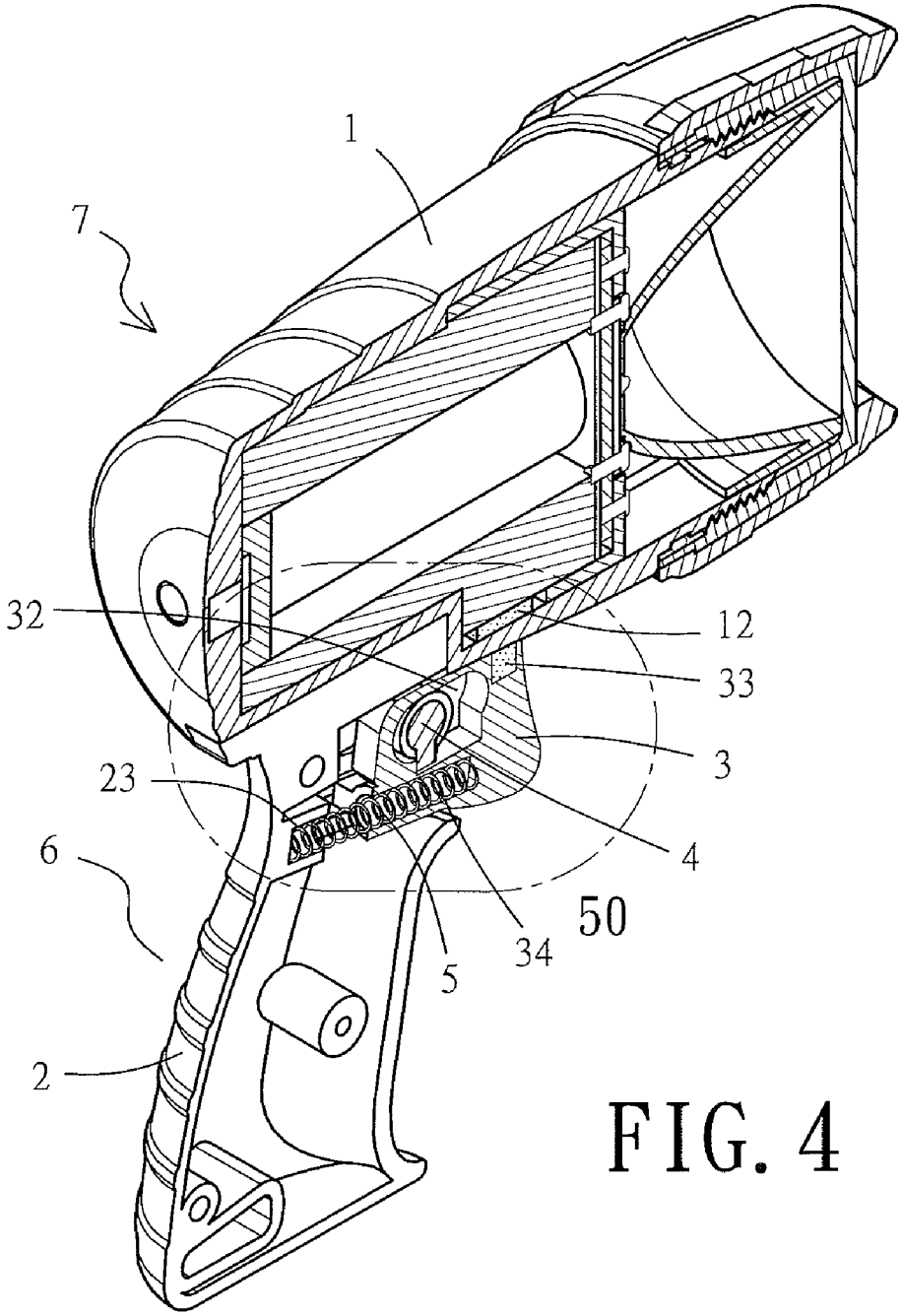
FIG. 4 is a cross-sectional view of the flashlight of the present invention.
Figure 5:
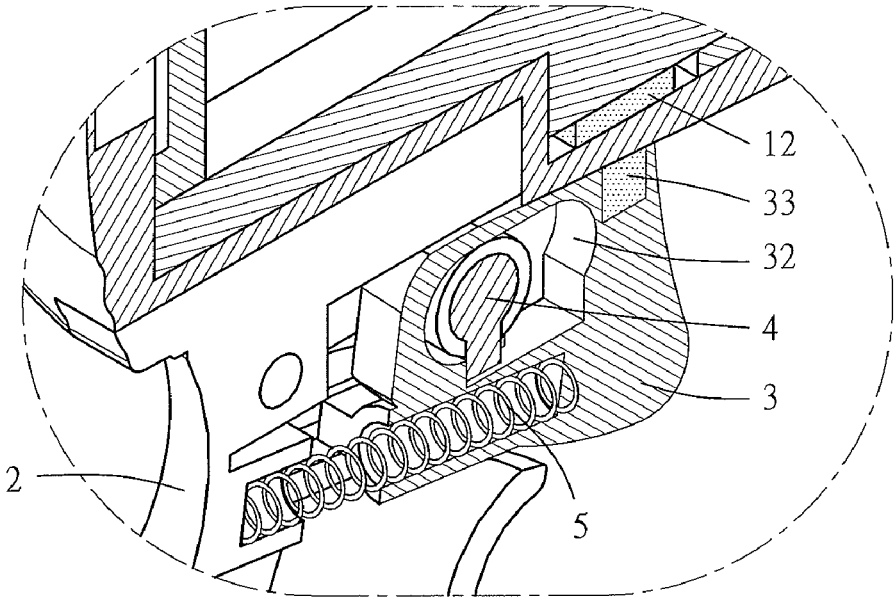
FIG. 5 is an enlarged view of a circled area 50 of FIG. 4.
Figure 6:
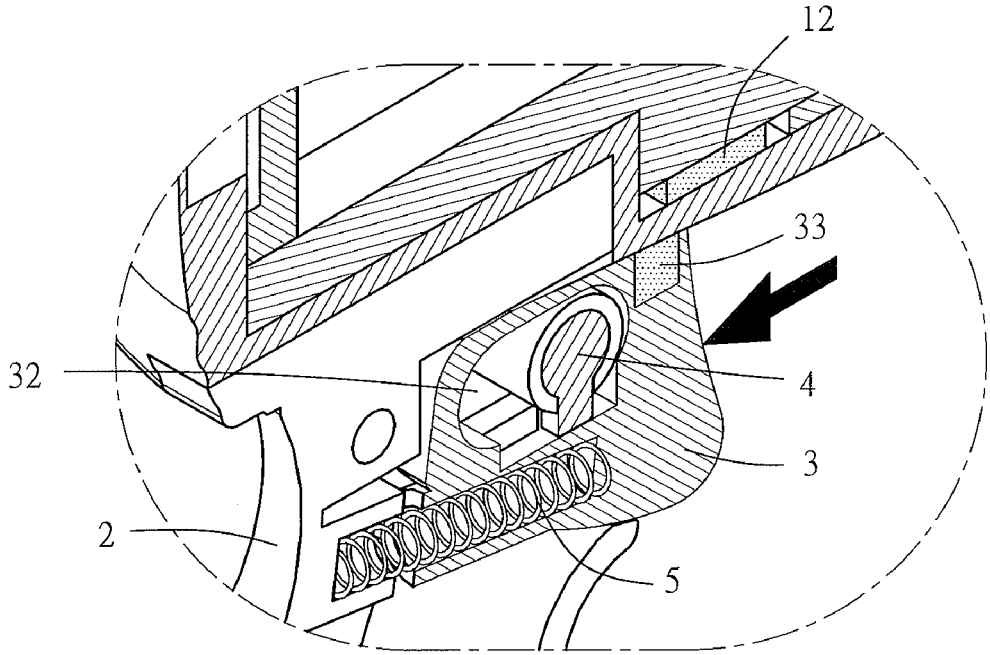
FIG. 6 is a schematic drawing according to FIG. 5 showing the trigger pulled.
Figure 7:
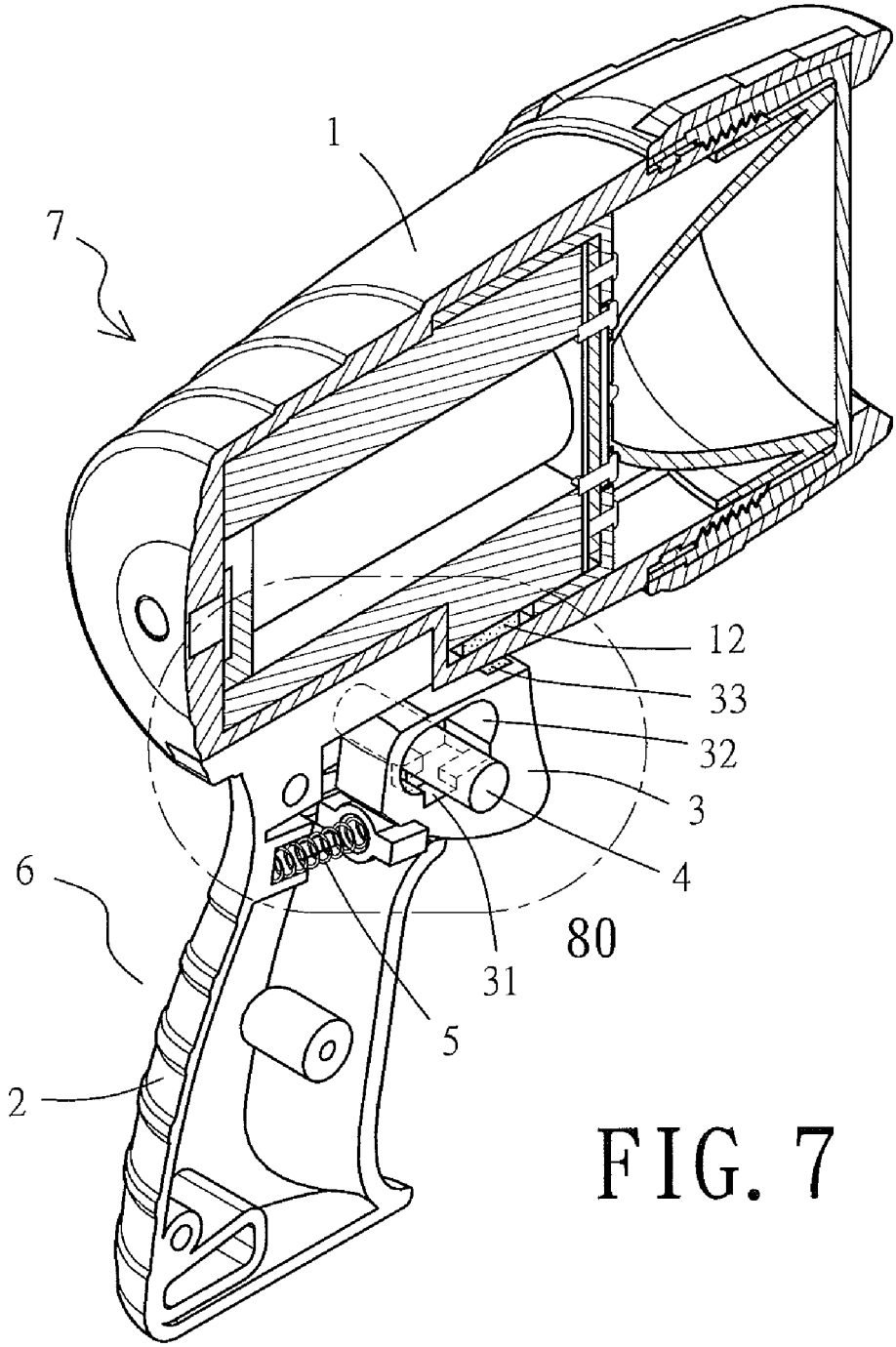
FIG. 7 is a schematic drawing of the present invention with the flashlight only partially sectioned.

Each of the two housing parts (2) is formed with a notch (21) for accommodating the trigger (3), as shown in FIG. 1 and FIG. 4. A zigzag room (31) is formed at a lower part of the trigger (3) and communicated with openings (32) formed at two laterals of the trigger (3), so that the safety mechanism (4) having a downward extending retaining portion (41) is allowed to be set in the zigzag room (31) with the retaining portion (41) fitting the zigzag room (31) at the lower part of the trigger (3), as shown in FIG. 7. In such case, the safety mechanism (4) has two ends thereof jutting out of two aligned holes (22) formed on the two housing parts (2). A magnet (33) is provided at an upper surface of the trigger (3) for removably engaging a reed switch (12) installed on the flashlight main body (1), as shown in FIG. 5 and FIG. 6. A hole (34) is formed at a rear surface of the trigger (3) for receiving one end of the spring (5), as shown in FIG. 1 and FIG. 4, such that an opposite end of the spring (5) is received in recesses (23) formed in the two housing parts (2) to press against the housing parts (2), thereby enabling the trigger (3) to resiliently move to and fro. After the trigger (3), the safety mechanism (4) and the spring (5) are properly arranged with respect to the housing parts (2), a bolt (61) passing through passages (24) formed through the two housing parts (2) can engage with a nut (62) to integrate the handle (6) as an unitary assembly.

Figure 8:
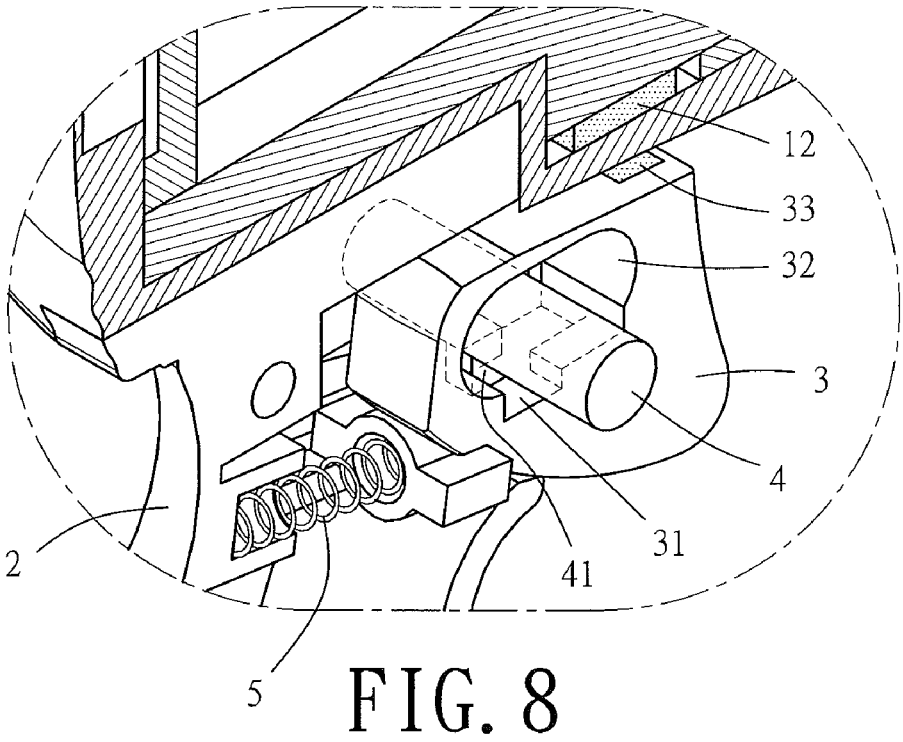
FIG. 8 is an enlarged view of a circled area 80 of FIG. 7.
Figure 9:
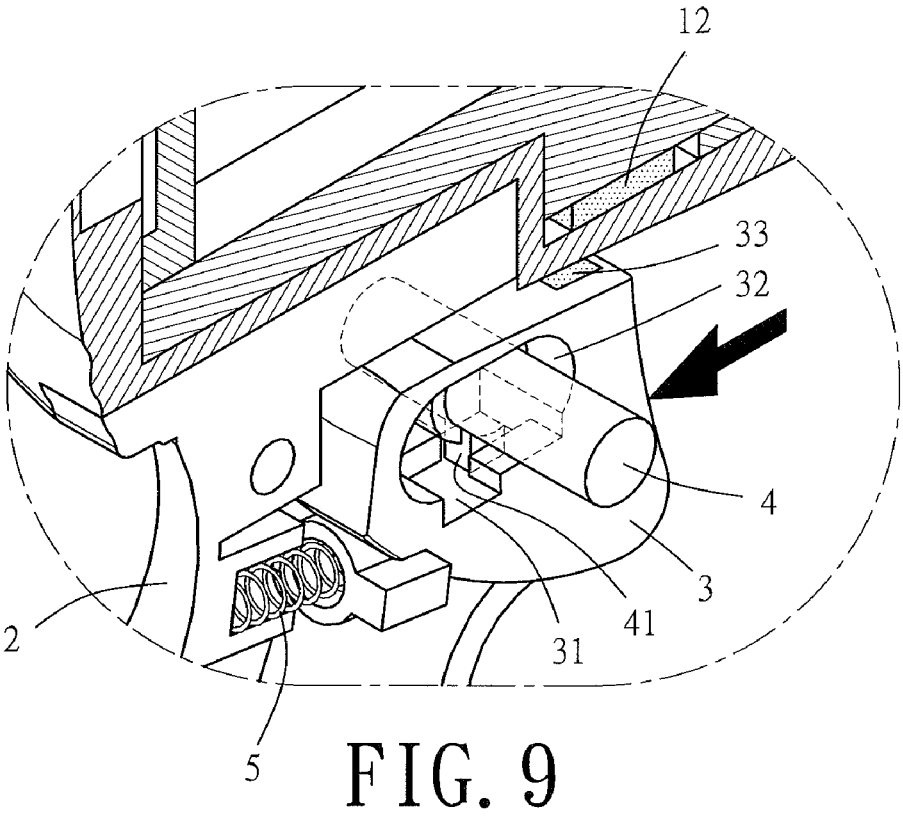
FIG. 9 is a schematic drawing according to FIG. 8 showing the trigger pulled.
Figure 10:
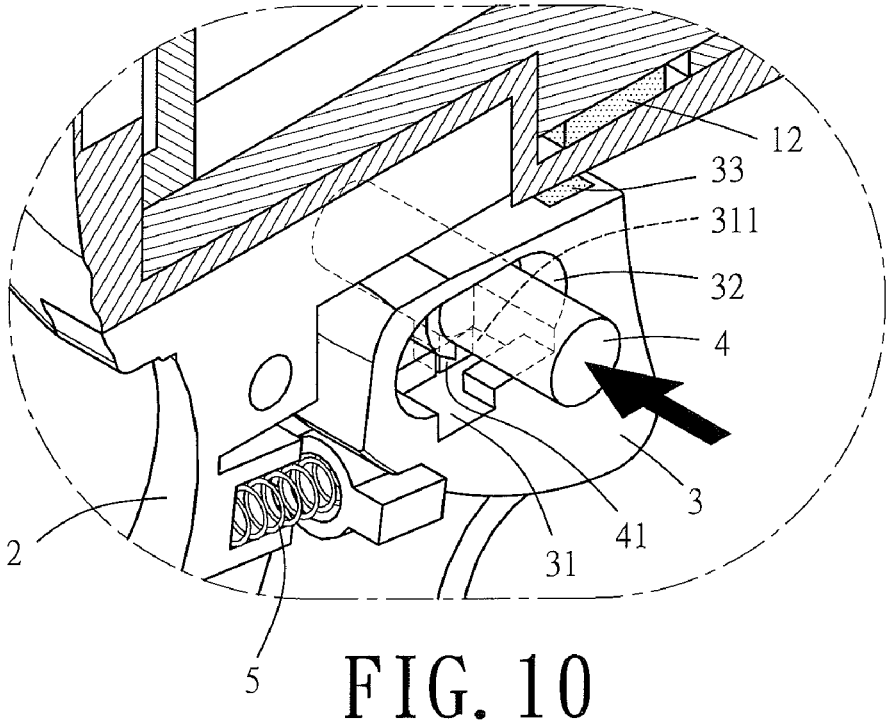
FIG. 10 is a schematic drawing showing the handle having a safety mechanism pushed to be positioned.

The assembled handle (6) is then ready to be combined with the main body (1) to complete the flashlight (7) as shown in FIG. 1 and for controlling a light source provided in the main body (1). Referring to FIG. 5 and FIG. 6, when the trigger (3) is pulled backward in the direction indicated by the arrow in FIG. 6, the magnet (33) departs from the reed switch (12) on the main body (1), and when the trigger (3) is then released, the spring (5) makes the magnet (33) return to its normal position and couple with the reed switch (12) of the main body (1) again, thereby switching the light source in the main body (1) in terms of light intensity, blinking, and on/off status according to preset programs. In other words, the trigger's going to and fro is a mechanism to control the illumination of the flashlight. For the purpose of the present invention, the illumination of the flashlight may be switched by operating the trigger (3) among low intensity, high intensity, blinking and off In addition, the flashlight (7) assembled as shown FIG. 7 is designed to be held in a certain illumination phase temporarily. Referring to FIG. 8 and FIG. 9, when the trigger (3) is pulled backward in the direction indicated by the arrow in FIG. 9, the openings (32) have their front ends coming to the safety mechanism (4), so that the safety mechanism (4) at this time is transversely movable in the openings (32) of the trigger (3) under a lateral pushing force, as shown in FIG. 10 because the retaining portion (41) of the safety mechanism (4) is transversely free at the front end of the zigzag room (31). When the safety mechanism (4) the front end of the zigzag room (31) is transversely moved in a predetermined direction, the retaining portion (41) at its bottom is placed into a limiting site (311) formed in the zigzag room (31). At this time, the trigger is positioned by the retaining portion at the bottom of the safety mechanism, so that the trigger (3) is retained from returning to its normal position even though the spring (5) keeps pushing it forward, thereby holding the flashlight in the current illumination phase temporarily. When the flashlight is held in a certain status, such as the high intensity phase, the trigger (3) is not operatable for switching the flashlight into another illumination phase.

Figure 11:
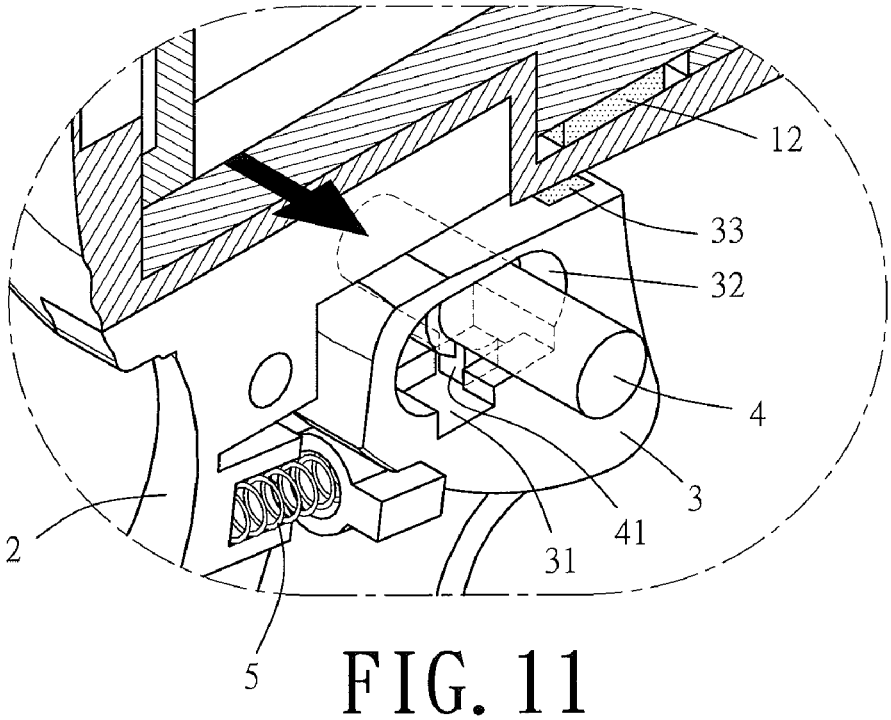
FIG. 11 is a schematic drawing showing the safety mechanism being pushed reversely to release the positioned status.

For freeing the flashlight from the illumination phase held temporarily, referring to FIG. 11, the safety mechanism (4) is to be pushed reversely, namely in the direction indicated by the arrow in FIG. 11, so as to drive the retaining portion (41) at its bottom to leave the limiting site (311) of the zigzag room (31) of the trigger (3), thereby allowing the trigger (3) to be driven by the spring (5) again and allowing the flashlight to be switched among low intensity, high intensity, blinking and off as desired.

What is claimed is:

1. A structurally improved flashlight, comprising a main body and a handle coupled to the main body at a guiding groove depressed from a bottom of the main body;

the handle having a pair of matching housing parts, a trigger, a safety mechanism and a spring; each of the two housing parts having a notch for accommodating the trigger; a zigzag room being formed at a lower part of the trigger and communicated with openings formed at two laterals of the trigger, so that the safety mechanism having a downward extending retaining portion is allowed to be set in the zigzag room with two ends of the safety mechanism jutting out of two aligned holes formed on the two housing parts; a magnet being provided at an upper surface of the trigger for removably engaging a reed switch installed on the main body; a hole being formed at a rear surface of the trigger for receiving one end of the spring, such that an opposite end of the spring is received in recesses formed in the two housing parts to press against the housing parts, thereby enabling the trigger to resiliently move to and from; and the handle such assembled serving to control illumination phases of the flashlight; when pulled backward, the trigger making the magnet depart from the reed switch on the main body, and when released, the trigger returning to a normal position thereof to make the magnet approach and correspond to the reed switch again, thereby switching a light source in the main body in terms of light intensity, blinking, and on/off status according to preset programs.

2. A structurally improved flashlight, comprising a main body and a handle coupled to the main body at a guiding groove depressed from a bottom of the main body;

the handle having a pair of matching housing parts, a trigger, a safety mechanism and a spring; a trigger being placed in a room formed in the two housing parts, openings being formed on laterals of the trigger for receiving the safety mechanism therebetween, a zigzag room being formed at a lower part of the trigger between the openings for receiving a retaining portion provided at a bottom of the safety mechanism such that the safety mechanism has two ends thereof jutting out of passages provided on the two housing parts, a magnet being deposited on an upper surface of the trigger for removably engaging a reed switch installed on the main body, and a spring being arranged between a hole formed at a rear surface of the trigger and recesses formed on the two housing parts, so as to enable the trigger to resiliently move to and from; and when manually pushed through one of the openings formed at the lateral of the trigger, the safety mechanism moving in a predetermined direction so that the retaining portion corresponding to a front end of the zigzag room is allowed to be placed into a limiting site formed at a side of the zigzag room, which limiting site retains the safety mechanism and disallows the trigger to be pushed frontward by the spring, thereby holding the flashlight in a certain illumination phase temporarily, and, for releasing the flashlight from the illumination phase, when the safety mechanism is manually pushed through the other opening, the retaining portion leaving the limiting site of the zigzag room, so as to allow the trigger to be pushed frontward by the spring again.

* * * * *